US007483003B2

(12) United States Patent
Nogawa

(10) Patent No.: US 7,483,003 B2
(45) Date of Patent: Jan. 27, 2009

(54) DRIVE CIRCUIT AND DISPLAY SYSTEM WITH SAID DRIVE CIRCUIT

(75) Inventor: Masashi Nogawa, Tokyo (JP)

(73) Assignee: Texas Instruments Incorporated, Dallas, TX (US)

( * ) Notice: Subject to any disclaimer, the term of this patent is extended or adjusted under 35 U.S.C. 154(b) by 493 days.

(21) Appl. No.: 10/865,715

(22) Filed: Jun. 9, 2004

(65) Prior Publication Data

US 2005/0062685 A1 Mar. 24, 2005

(30) Foreign Application Priority Data

Jun. 9, 2003 (JP) ..... 2003-163504

(51) Int. Cl.
*G09G 3/32* (2006.01)
*G09G 3/14* (2006.01)

(52) U.S. Cl. ..... 345/82; 345/39; 345/46

(58) Field of Classification Search ..... 327/110, 327/514; 345/39, 76–83, 109
See application file for complete search history.

(56) References Cited

U.S. PATENT DOCUMENTS 5,594,463 A * 1/1997 Sakamoto ..... 345/76
6,995,519 B2 * 2/2006 Arnold et al. ..... 315/169.3
7,113,156 B2 * 9/2006 Hashimoto ..... 345/77
2002/0021269 A1 * 2/2002 Rast ..... 345/82
2004/0196239 A1 * 10/2004 Kwon ..... 345/92
2007/0080905 A1 * 4/2007 Takahara ..... 345/76

* cited by examiner

*Primary Examiner*—Sumati Lefkowitz
*Assistant Examiner*—Srilakshmi K Kumar
(74) *Attorney, Agent, or Firm*—William B. Kempler; W. James Brady, III; Frederick J. Telecky, Jr.

(57) ABSTRACT

The objective of this invention is to provide a drive circuit and display system that can efficiently transfer prescribed information indicating an abnormality in the drive current supplied to the display elements to a control device. The control data used for controlling the turning on and off of LEDs are shifted sequentially from the first section to the final section of LED drivers 10-1-10-K connected in cascade. In the drive circuit of each section, the control data input from the previous section are held in the first data holding means synchronously with clock signal CLK. Then, the data held in the first data holding means are held in the second data holding means synchronously with latch signal XLAT. Current corresponding to the control data of the second data holding means is supplied to LEDs 40-1-40-M. On the other hand, when new control data are held in the second data holding means, the data indicating prescribed information concerning abnormal functioning of the LED, etc. are held in the first data holding means. The data are output sequentially from the drive circuit in the final section and are input into control device 20.

12 Claims, 10 Drawing Sheets

10-K
10-2
10-1
LED DRIVERS
T1
T2
T3
T4
To1
To16
40-M
40-(M-15)
40-32
40-17
40-16
40-1
VCC
DIN
XLAT
DOUT
CLK
CONTROL DATA GENERATING UNIT
21
DATA ACQUISITION UNIT
22
ABNORMALITY DETECTION UNIT
23
20
CLOCK GENERATING UNIT
30

2-i
1-i
VCC
40-m
Toi
Q2
R1
CV1
A1
EN
CP1
AND1
CV2
S2-i
DOi

DRIVE CIRCUIT AND DISPLAY SYSTEM WITH SAID DRIVE CIRCUIT

FIELD OF THE INVENTION

The present invention pertains to a drive circuit and a display system with this drive circuit. The drive circuit and the display system, for example, are used to drive LEDs or other display elements.

BACKGROUND OF THE INVENTION

FIG. 10 is a block diagram illustrating an example of the part used for driving one line of LEDs on a screen in a general LED display system.

The LED display system shown in FIG. 10 has K (K is an integer of 2 or more) LED drivers U-1, . . . U-K and controller 1 used to control the drivers.

Although not indicated in the figure, the cathodes of the LEDs of the drive objects are connected to the drive signal output terminals Td1-Td16 of LED drivers U-1, . . . , U-K, and the power supply voltage is supplied to the anodes of the LEDs.

LED driver U-k (k is an integer in the range of 1-K) has 16 terminals Td1, . . . Td16 connected to the cathodes of the LEDs, terminal Ta for inputting the on/off control data for the LEDs, terminal Tc for outputting the control data, terminal Tb for inputting clock signal CLK, terminal Tc for inputting latch signal XLAT used for holding the control data, and terminal Tf for outputting an error signal.

K LED drivers U-1-U-K are connected in cascade via terminals Ta and Te. In other words, control data Din output from controller 1 is input to the terminal Ta of LED driver U-1 in the first section. The control data output from the terminal Te of the LED driver in the previous section is input to the terminal Ta of LED drivers U-2-U-K that follow the first section.

Also, clock signal CLK and latch signal XLAT generated by controller 1 are input to LED driver U-k in each section.

In the example shown in FIG. 10, LED driver U-k has flip-flops FF1, . . . , FF16, latch circuits LA1, . . . LA16, drive signal output circuit O1, OR-gate OR1, and transistor Q1.

16 flip-flops FF1-FF16 are connected in cascade between terminals Ta and Te and operate as shift registers. In other words, the control data input to terminal Ta is sequentially shifted from the flip-flop in the first section FF1 to the flip-flop in the final section FF16 connected in cascade synchronously with clock signal CLK and is finally output from terminal Te.

Latch circuit LAi (i is an integer in the range of 1-16) holds the data held in flip-flop FFi synchronously with latch signal XLAT.

In other words, when latch signal XLAT is at the high level, the input data are output directly. When latch signal XLAT changes from the high level to the low level, the data being input are held. When latch signal XLAT is at the low level, the output data are held continuously.

Drive signal output circuit O1 controls the LED drive current flowing to terminal Tdi corresponding to the data held in latch circuit LAi. For example, when the data held in latch circuit LAi is '1,' current for turning on the LED is supplied to output terminal Tdi. When the held data is '0,' the current is cut off to turn off the LED.

Also, drive signal output circuit O1 checks for abnormalities in the drive signal caused by damage to an LED or problems in the current drive circuit for each output channel and, if there are any abnormalities, outputs an error signal Err.

Said error signal Err is a 16-bit signal. The bit of the output channel with a detected abnormality goes to the high level.

OR-gate OR1 outputs the logical sum of error signal Err output from the drive signal output circuit. Consequently, if an abnormality is detected in any of the 16 output channels, the output of OR-gate OR1 goes to the high level.

The output signal of OR-gate 1 is input to the base of transistor Q1. The emitter of the transistor is connected to a reference potential line, and its collector is connected to terminal Tf. Consequently, if an abnormality is detected in any of the 16 output channels, transistor Q1 will turn on, and terminal Tf will be connected to the reference potential line.

The terminals Tf of LED drivers U-1-U-16 are connected to a common line L1. The wiring is connected to power supply line Vcc via resistor Ra. Consequently, line L1 is at the high level in the normal state. If an abnormality in the drive signal is detected in any of the output channels of any of the LED drivers, line L1 goes to the low level. Controller 1 detects the abnormality in the drive signal based on the level of line L1.

The LED display system with the configuration shown in FIG. 10 operates as follows.

First, in controller 1, the control data for turning each LED on or off that constitutes a pixel is generated corresponding to the image to be displayed. The generated control data Din is sequentially output from controller 1 synchronously with clock signal CLK. The output control data Din is sequentially shifted in the shift registers comprised of flip-flops FF1-FF16 from the LED driver in the first section U-1 to the final section U-16 connected in cascade. When the desired control data is held in the flip-flops FF1-FF16 of each LED driver as a result of the aforementioned shifting, a high level pulse is output as latch signal XLAT from controller 1. As a result, the control data of flip-flops F1-F16 are held in latch circuits LA1-LA16, and each LED is turned on or off corresponding to the control data.

Also, the level of line L1 is monitored by controller 1. When that level goes low, an abnormality in the drive signal is detected. When an abnormality is detected, for example, details concerning the abnormality are displayed on the display device, and a prescribed process is executed.

However, the error signal transmitted from the LED driver to controller 1 via line L1 indicates only whether there is an output channel with an abnormal drive signal among any of the output channels of any of the LED drivers. It is unable to specify which LED driver or associated output channel has the abnormality by using the aforementioned error signal alone. In order to obtain more specific information about the location of the abnormality, for example, it is necessary to transmit various test signals from controller 1 to investigate the error signal of line L1.

As described above, in the LED display system shown in FIG. 10, it is difficult to obtain the specific information concerning the abnormality of the drive signal of the LED drivers.

In another method, all of the error signals output for each LED driver or its output channel are input into controller 1. In this case, however, when there is a large number of LEDs, the number of the error signals to be checked is also increased, and the number of lines becomes very large.

A general object of the present invention is to solve the aforementioned problems by providing a drive circuit that can efficiently transfer the abnormality of drive signal or other specific information to the external device without increasing the number of lines.

The present invention may also provide a display system that can efficiently obtain the abnormality of drive signal or other specific information from the drive circuits of the display elements while having a simple configuration without increasing the number of lines.

SUMMARY OF THE INVENTION

This and other objects and features may be provided, in accordance with a first aspect of the present invention by a drive circuit having the following: a first data holding means that holds the input control data synchronously with a supplied clock signal, a second data holding means that holds the control data held in the first data holding means synchronously with a supplied latch signal, a signal output means that generates a drive signal corresponding to the control data held in the second data holding means and outputs the drive signal to a drive object, a data updating means that updates the control data held in the first data holding means to data indicating prescribed information when new control data are held in the second data holding means.

According to a second aspect of the present invention, the control data are held in the first data holding means synchronously with the clock signal. The control data held in the first data holding means are held in the second data holding means synchronously with the latch signal. The drive signal corresponding to the control data held in the second data holding means is output from the signal output means to the drive object. On the other hand, when new control data are held in the second holding means, the control data held in the first data holding means are updated with the data indicating prescribed information by the data updating means. In this way, the data indicating the prescribed information can be obtained from the first data holding means.

The drive circuit of the second aspect of the present invention may also have a first judgment means that determines whether the level of the drive signal to be output by the signal output means has reached a prescribed level. The data updating means updates the control data held in the first data holding means with data corresponding to the judgment result of the first judgment means.

In this way, in the drive circuit of the second aspect of the present invention, the data indicating whether the level of the drive signal has reached a prescribed level can be obtained from the first data holding means.

The drive circuit of the second aspect of the present invention may also have a second judgment means that determines whether the temperature of the drive circuit has reached a prescribed temperature. The data updating means updates the control data held in the first data holding means with data corresponding to the judgment result of the second judgment means.

In this way, in the drive circuit of the second aspect of the present invention, the data indicating whether the temperature of the aforementioned drive circuit has reached a prescribed temperature can be obtained from the aforementioned first data holding means.

The display system provided by the a third aspect of the present invention comprises multiple display elements, multiple drive circuits that generate drive signals corresponding to the input control data and supply the drive signals to the display elements and are connected in cascade so that the control data input to the first section can be shifted sequentially to the various sections that follow the first section, a control data generating means that generates the control data corresponding to the image to be displayed, synchronizes the generated control data with a supplied clock signal, and inputs the control data sequentially to the drive circuit in the first section of the cascade connection, and a data acquiring means that can obtain data output sequentially from the drive circuit in the last section of the cascade connection. The drive circuit comprises a first data holding means that holds the input control data synchronously with a supplied clock signal, a second data holding means that holds the control data held in the first data holding means synchronously with a supplied latch signal, a signal output means that generates a drive signal corresponding to the control data held in the aforementioned second data holding means and outputs the drive signal to a drive object, and a data updating means that updates the control data held in the aforementioned first data holding means with data indicating prescribed information when new control data are held in the second data holding means.

According to the third aspect of the present invention, the control data corresponding to the image to be displayed is generated in the control data generating means. The generated control data are input sequentially to the drive circuit of the first section in the cascade connection synchronously with the supplied clock signal. The control data input to the first section are shifted sequentially to the various sections that follow the first section.

According to a fourth aspect of the present invention, the drive circuit of each section of the cascade connection, the control data input from the previous section are held in the first data holding means synchronously with the clock signal. The control data held in the first data holding means are held in the second data holding means synchronously with the latch signal. The drive signal corresponding to the control data held in the second data holding means is output from the signal output means to the display element. On the other hand, when new control data are held in the second data holding means, the control data held in the first data holding means is updated with the data indicating prescribed information by the data updating means.

According to a fifth aspect of the present invention the data updated by the updating means is sequentially output from the drive circuit in the final section of the cascade connection and is obtained by the data acquiring means.

REFERENCE NUMERALS AND SYMBOLS AS SHOWN IN THE DRAWINGS

In the FIGS., 10-1-10-K, 10A-1-10A-K, 10B-1-10B-K represent LED drivers, 20, 20B represent control devices, 21 represents control data generating unit, 22 represents data acquisition unit, 23 represents abnormality detection unit, 25 represents sensor processing unit, 30 represents clock generating unit, 40-1-40-M represent LEDs, 60-1-60-M represent touch sensors, 1-1-1-16 represent signal output units, 2-1-2-16 represent signal level judgment units, 4 represents a temperature judgment unit, FF1-1-FF1-16, FF2-1-FF2-16 represent flip-flops, OR1-1-OR1-16, OR2-1-OR2-16, OR3-1-OR3-16 represent OR-gates, IV1-1-IV1-16, IV2-1-IV2-16 represents inverters.

DESCRIPTION OF THE EMBODIMENTS

In the following, three embodiments of the present invention will be explained with reference to the FIGS.

First Embodiment

Figure 1:
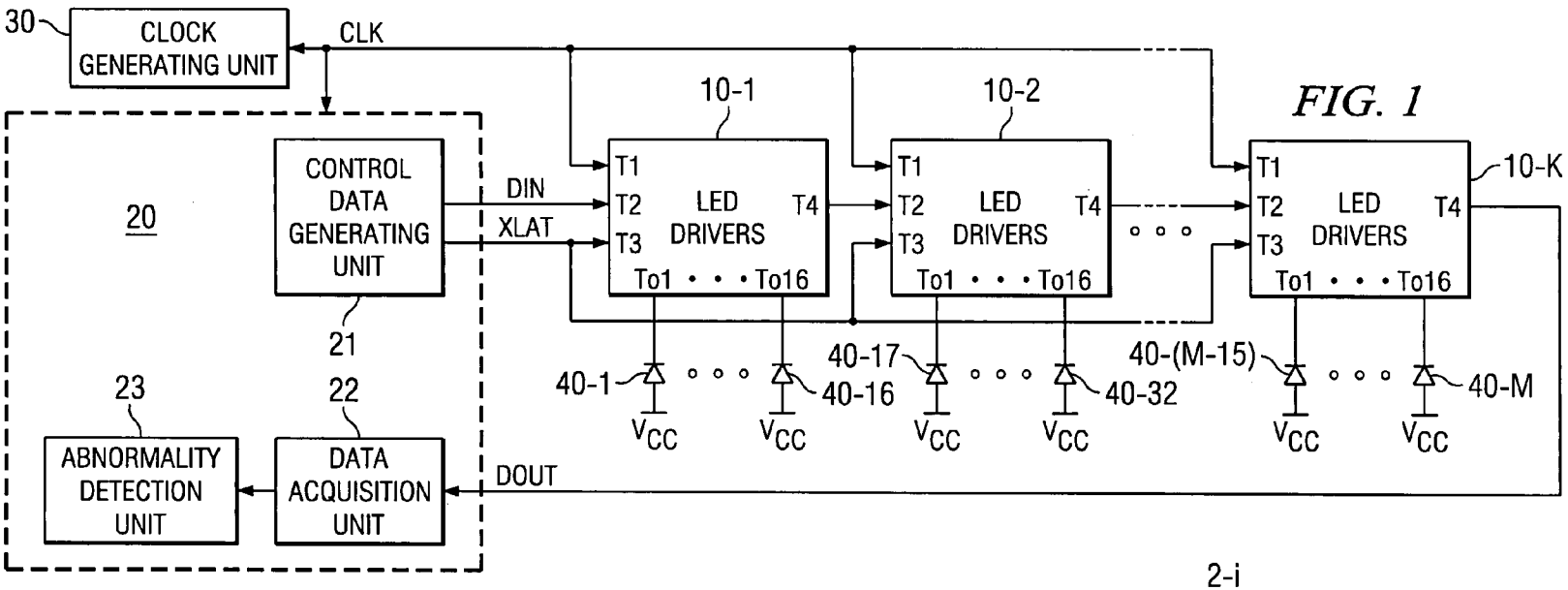
FIG. 1 is a block diagram illustrating an example of the configuration of the LED display system disclosed in the first embodiment of the present invention.

FIG. 1 is a block diagram illustrating an example of the configuration of the LED display system disclosed in a first embodiment of the present invention. In order to simplify the explanation of the example shown in FIG. 1, only the parts corresponding to one line of the screen are shown in the figure.

The LED display system shown in FIG. 1 has LED drivers 10-1, . . . , 10-K (K is an integer of 2 or more), control device 20, clock generating unit 30, LED 40-1,. . . , 40-M (M=16×K).

Also, control device 20 has control data generating unit 21, data acquisition unit 22, and abnormality detection unit 23.

LED drivers 10-1, . . . , 10-K are one embodiment of the drive circuit disclosed in the present invention.

Control data generating unit 21 is one embodiment of the control data generating means disclosed in the present invention.

Data acquisition unit 22 is one embodiment of the data acquiring means disclosed in the present invention.

Abnormality detection unit 23 is one embodiment of the abnormality detecting means disclosed in the present invention.

LED Drivers 10-1-10-K

LED driver 10-k (k is an integer in the range of 1-K) has output terminals To1-To16 corresponding to the 16 drive signal output channels. The cathodes of LEDs 40-m (m is an integer in the range of 1-M) are connected to these output terminals.

LED driver 10-k also has input terminal T2 for control data used for controlling on/off of the LED and its output terminal T4 as well as input terminal T1 for clock signal CLK and input terminal T3 for latch signal XLAT.

K LED drivers 10-1-10-K are connected in cascade via terminals T2 and T4.

In other words, control data Din output from control device 20 is input to the terminal T2 of LED driver 10-1 in the first section. The control data output from the terminal T4 of the LED driver in the previous section is input to terminal T2 of LED drivers 10-2-10-K in the sections that follow the first section.

Also, clock signal CLK and latch signal XLAT generated in control device 20 are input to LED driver 10-k in each section.

Figure 2:
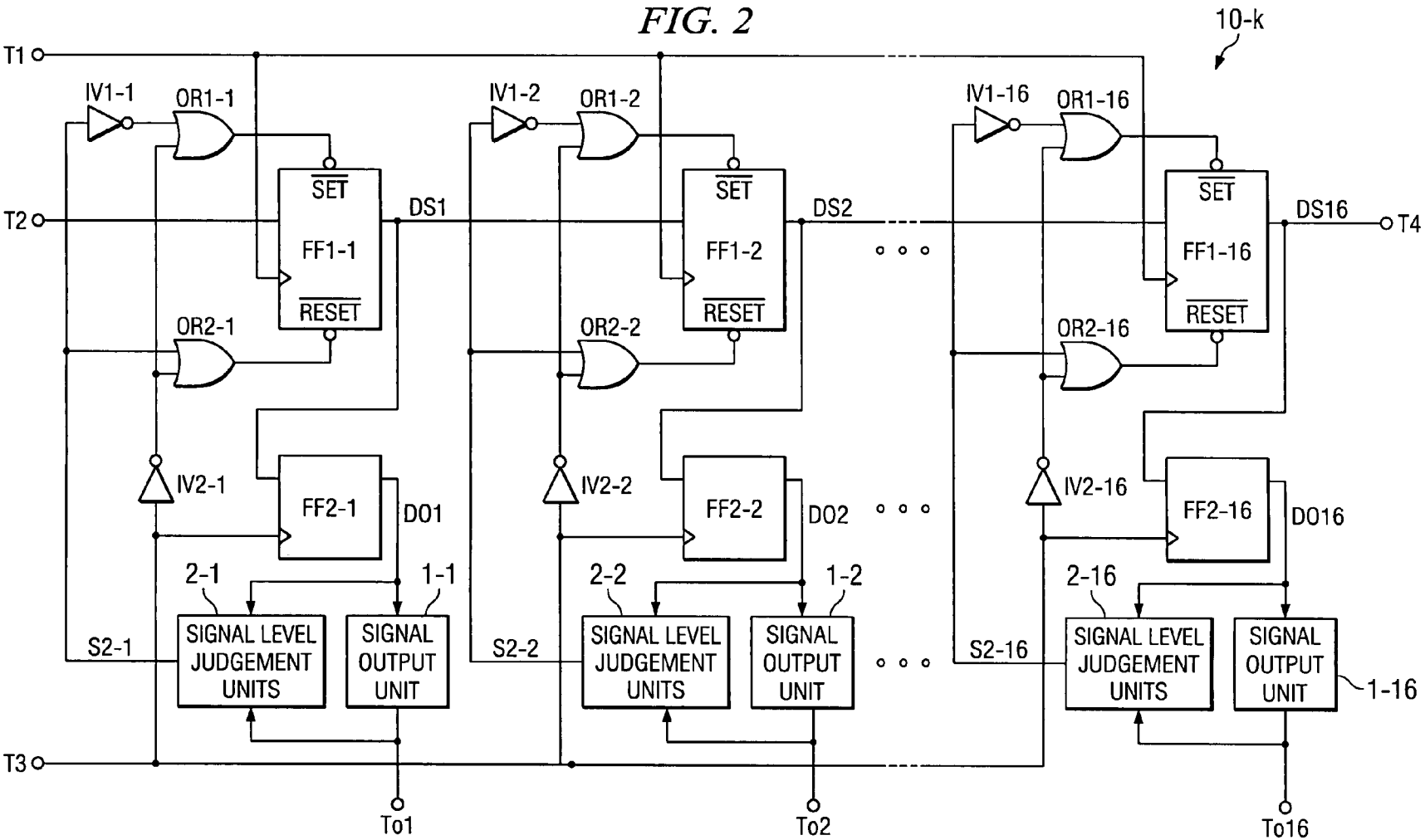
FIG. 2 is a block diagram illustrating an example of the configuration of the LED driver disclosed in the first embodiment of the present invention.

FIG. 2 is a block diagram illustrating an example of the configuration of said LED driver 10-k.

LED driver 10-k shown in FIG. 2 has signal output units 1-1-1-16, signal level judgment units 2-1-2-16, flip-flops FF1-1-FF1-16, flip-flops FF2-2-FF2-16, OR-gates OR1-1-OR1-16, OR-gates OR2-1-OR2-16, inverters IV1-1-IV1-16, inverters IV2-1-IV2-16.

The unit including flip-flops FF1-1-FF1-16 is one embodiment of the first data holding means used in the present invention.

The unit including flip-flops FF2-1-FF2-16 is one embodiment of the second data holding means used in the present invention.

The unit including signal output units 1-1-1-16 is one embodiment of the signal output means used in the present invention.

The unit including signal level judgment units 2-1-2-16 is one embodiment of the first judgment means used in the present invention.

The unit including OR-gates OR1-1-OR1-16, OR-gates OR2-1-OR2-16, inverters IV1-1-IV1-16, inverters IV2-1-IV2-16 is one embodiment of the data updating means used in the present invention.

Flip-Flops FF1-1-FF1-16

16 flip-flops FF1-1-FF1-16 are connected in cascade between terminals T2 and T4 and operate as shift registers.

In other words, flip-flop FF1-1 in the first section of the cascade connection inputs data from terminal T2. Flip-flops FF1-2-FF1-16 in the various sections that follow the first section input the data held in the flip-flop of the previous section. Each of the input data is held synchronously with clock signal CLK. The flip-flop FF1-16 of the final section outputs the held data to terminal T4.

Also, flip-flop FF1-i (i is an integer in the range of 1-16) has a set terminal and a reset terminal.

When the set terminal and the reset terminal are both at the high level, flip-flop FF1-i operates as usual. That is, it holds the input data synchronously with clock signal CLK.

When the set terminal goes to the low level (logic value '0'), flip-flop FF1-i keeps the held data to '1.'

When the reset terminal goes to the low level (logic value '0'), flip-flop FF1-i keeps the held data to '0.'

Flip-Flops FF2-1-FF2-16

Flip-flop FF2-i holds data DSi held in flip-flop FF1-i synchronously with latch signal XLAT. In the example shown in FIG. 2, data DSi of flip-flop FF1-i is held at the same time when latch signal XLAT switches from the low level to the high level.

(Signal Output Units 1-1-1-16)

Signal output unit 1-i generates a drive signal corresponding to data DOi held in flip-flop FF2-i and sends it to LED 40-m.

For example, it controls the current flowing to terminal Toi corresponding to data DOi held in flip-flop FF2-i and turns on or off LED 40-m connected to terminal Toi.

(Signal Level Judgment Units 2-1-2-16)

Signal level judgment unit 2-i determines whether the level of the drive signal output from signal output unit 1-i has reached a prescribed level.

For example, when LED 40-m is turned on by signal output unit 1-i, it is determined whether the voltage at terminal Toi has reached a prescribed voltage.

Figure 3:
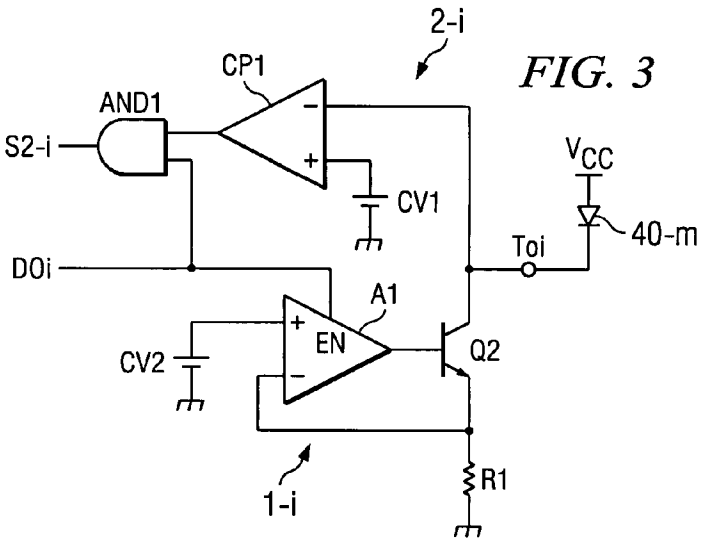
FIG. 3 is a circuit diagram illustrating an example of the configuration of the signal output unit and the signal level judgment unit.

FIG. 3 is a circuit diagram illustrating an example of the configuration of signal output unit 1-i and signal level judgment unit 2-i.

In the example shown in FIG. 3, signal output unit 1-i comprises amplifier A1, npn transistor Q2, resistor R1, and voltage output circuit CV2.

Signal level judgment unit 2-i comprises comparator CP1, voltage output circuit CV1, and AND gate AND1.

The collector of npn transistor Q2 is connected to terminal Toi; the emitter is connected to reference potential line GND via resistor R1; and the output voltage of amplifier A1 is applied to the base.

The voltage of voltage output circuit CV2 is input to the positive input terminal of amplifier A1, and the emitter of npn transistor Q2 is connected to the negative input terminal.

Amplifier A1 has an enable input EN. The amplifying operation is controlled corresponding to data DOi of flip-flop FF2-i supplied to said enable input EN. For example, if data DOi is '1,' amplifier A1 performs the normal amplification operation to output a signal corresponding to the voltage difference between the signals appearing at the input terminals. When data DOi becomes '0,' the output voltage is held at the reference potential.

Comparator CP1 outputs a signal with high level (logic value '1') when the voltage at terminal Toi is below the voltage of voltage output circuit CV1 and outputs a signal at the low level (logic value '0') otherwise.

Two-input AND gate AND1 outputs the logical product of the output signal of comparator CP1 and data DOi as signal S2-i.

In the circuit shown in FIG. 3, when data DOi is '1,' amplifier A1 performs a normal amplification operation. If the gain of amplifier A1 is sufficiently high, the base voltage of npn transistor Q2 is controlled in such a way that the emitter voltage of npn transistor Q2 becomes almost equal to the voltage of voltage output circuit CV2. In other words, a constant drive current corresponding to the voltage of voltage output circuit CV2 and the resistance of resistor R1 is supplied to LED 40-m. Consequently, LED 40-m is turned on.

At that time, since '1' is input to one of the inputs of AND gate AND1, output signal S2-i of AND gate AND1 will be equal to the output signal of comparator CP1.

If the drive current flowing to LED 40-m is normal, the voltage at terminal Toi will be below the potential of power supply voltage line Vcc by as much as the forward voltage of LED 40-m. Since the voltage of voltage output circuit CV1 is set to be below the voltage at terminal Toi during normal operation, the output signal of comparator CP1 will be '0.'

On the other hand, if LED 40-m is damaged and forms an open circuit, the current flowing from power supply line Vcc to resistor R1 via LED 40-m and npn transistor QZ will be almost zero. A large voltage difference will appear between the positive and negative terminals of amplifier A1, and its output voltage will increase. As a result, npn transistor Q2 turns on, the voltage at terminal Toi drops to a level near the reference potential, and the output signal of comparator CP1 is '1.'

Consequently, the output signal S2-i of signal level judgment unit 2-i is '1' when an abnormality in the drive current flowing to LED 40-m is detected.

Also, in the circuit shown in FIG. 3, when data DOi is '0,' since the output voltage of amplifier A1 drops to a level near the reference potential, npn transistor Q2 turns off, and light emission of LED 40-m stops. In this case, since the '0' of data DOi is input to one of the inputs of AND-gate AND1, the output signal S2-i of signal level judgment unit 2-i will be '0.'

OR-Gates OR1-1-OR1-16

Two-input OR-gate OR1-i outputs the logical sum of the signal obtained by inverting the logical value of the output signal S2-i of signal level judgment unit 2-i in inverter IV1-i and the signal obtained by inverting the logic value of latch signal XLAT in inverter IV2-i to the set terminal of flip-flop FF1-i.

Thus, when latch signal XLAT is at the low level, the set terminal of flip-flop FF1-i goes high irrespective of the output signal S2-i of signal level judgment unit 2-i. When latch signal XLAT is at the high level, the signal at the set terminal has the logic value obtained by inverting the logic value of output signal S2-i.

OR-Gates OR2-1-OR2-16

Two-input OR-gate OR2-i outputs the logical sum of the output signal S2-i of signal level judgment unit 2-i and the signal obtained by inverting latch signal XLAT in inverter IV2-i to the reset terminal of flip-flop FF1-i.

Thus, when latch signal XLAT is at the low level, the reset terminal of flip-flop FF1-i goes high irrespective of the output signal S2-i of signal level judgment unit 2-i. When latch signal XLAT is at the high level, the signal at the reset terminal is at the same level as output signal S2-i.

LED drivers 10-1-10-K were explained in the foregoing.

Control Data Generating Unit 21

Control data generating unit 21 generates control data corresponding to the image to be displayed. The generated control data are input sequentially to drive circuit 10-1 in the first section of the cascade connection synchronously with clock signal CLK supplied from clock generating unit 30.

Also, at the time that the generated control data are held in flip-flop FF1-i corresponding to each output channel of LED driver, a high-level pulse is output as latch signal XLAT, and data DSi of flip-flop FF1-i is held in flip-flop FF2-i.

Data Acquisition Unit 22

Data acquisition unit 22 obtains the data output sequentially from LED driver 10-K in the final section of the cascade connection.

As will be described below, after the high-level pulse is output as latch signal XLAT from control data generating unit 21, from LED driver 10-K, the data reporting the abnormality of the drive signal in each output channel of LED drivers 10-1-10-K are output sequentially synchronously with clock signal CLK. Data acquisition unit 22 obtains the data indicating prescribed information output from said LED drivers 10-1-10-K.

Abnormality Detection Unit 23

Abnormality detection unit 23 detects the abnormality of LED drivers 10-1-10-K on the basis of the data obtained in data acquisition unit 22 and reports abnormalities of the drive signal of each output channel.

Clock Generating Unit 30

Clock generating unit 30 generates clock signal CLK supplied to control device 20 or LED drivers 10-1-10-K.

In the following, the operation of the LED display system disclosed in this embodiment having the aforementioned configuration will be explained.

Control data Din generated in control data generating unit 21 are input sequentially to terminal T2 of LED driver 10-1 in the first section of the cascade connection synchronously with clock signal CLK, shifted sequentially by flip-flops FF1-1-FF1-16 of LED driver 10-1, and output from terminal T4. The control data output from LED driver 10-1 in the first section are input sequentially to terminal T2 of LED driver 10-2 in the next section, shifted sequentially by flip-flops FF1-1-FF-16, and output from terminal T4. In this way, the control data output from control data generating unit 21 are shifted sequentially from the first section to the final section in LED drivers FF1-1-FF1-16 connected in cascade.

When the control data corresponding to the image to be displayed are held in flip-flops FF1-1-FF1-16 corresponding to the output channels of each LED driver as a result of the aforementioned shifting operation, a high-level pulse is generated as latch signal XLAT in control data generating unit 21 and is supplied to all LED drivers 10-1-10-K.

In this way, the control data held in flip-flops FF1-1-FF1-16 are held in flip-flops FF2-1-FF2-16 at the same time when latch signal XLAT switches from the low level to the high level. In signal output units 1-1-1-16, the drive currents of terminals To1-To16 are controlled corresponding to the control data held in flip-flops FF2-1-FF2-16 to turn on or off LED 40-1-40-M.

Also, when latch signal XLAT goes high, a signal obtained by inverting the logical value of the output signal S2-i of signal level judgment unit 2-i is input to the set terminal of flip-flop FF1-i via inverter IV1-i and OR-gate OR1-i. A signal with the same logic value as signal S2-i is input to the reset terminal of flip-flop FF1-i via OR-gate OR2-i.

When signal S2-i is '0' (drive signal normal), a '1' appears at the set terminal and a '0' at the reset terminal, and data '0' is held in flip-flop FF1-i. When signal S2-i is '1' (drive signal abnormal), a '0' appears at the set terminal and a '1' at the reset terminal and data '1' is held in flip-flop FF1-i.

In other words, when a high-level pulse is input as latch signal XLAT, if an abnormal drive signal is detected from the judgment result of the voltage level at terminal Toi, data '1' is held in flip-flop FF1-i. If no abnormality is detected, data '0' is held in flip-flop FF1-i. In this way, the control data held in flip-flops FF1-1-FF1-16 of each LED driver are updated with the data that report the abnormality of the output channels.

Like the control data, the updated data in flip-flops FF1-1-FF1-16 are synchronized to clock signal CLK and shifted sequentially in LED drivers FF1-1-FF1-16 connected in cascade, output sequentially from terminal T4 of LED driver 10-K in the last section, and obtained by the data acquisition unit 22 in control device 20. The data '1' included in the obtained data to indicate an abnormal drive signal is detected by the abnormality detection unit 23 of control device 20.

When the output channels with an abnormal drive signal are specified as described above, for example, the information of the output channels with the abnormality can be displayed on the display device using a processing device (not shown in the figure) in control device 20.

Figure 4A:
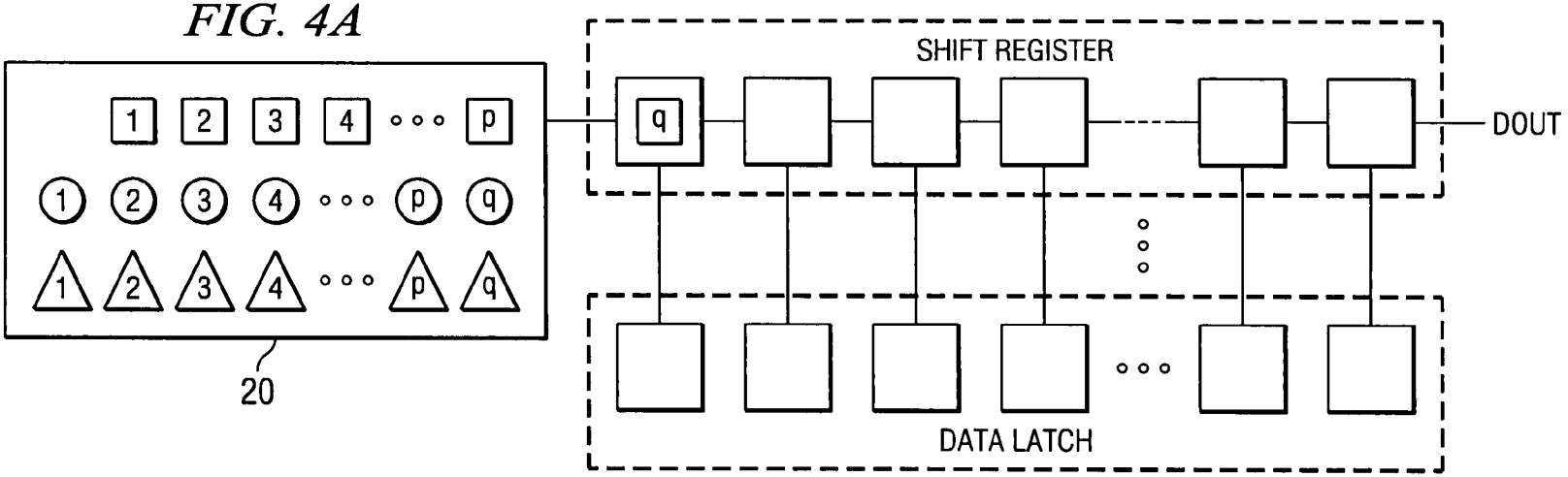
FIG. 4 is a first diagram illustrating the operation of the LED display system.
Figure 4B:
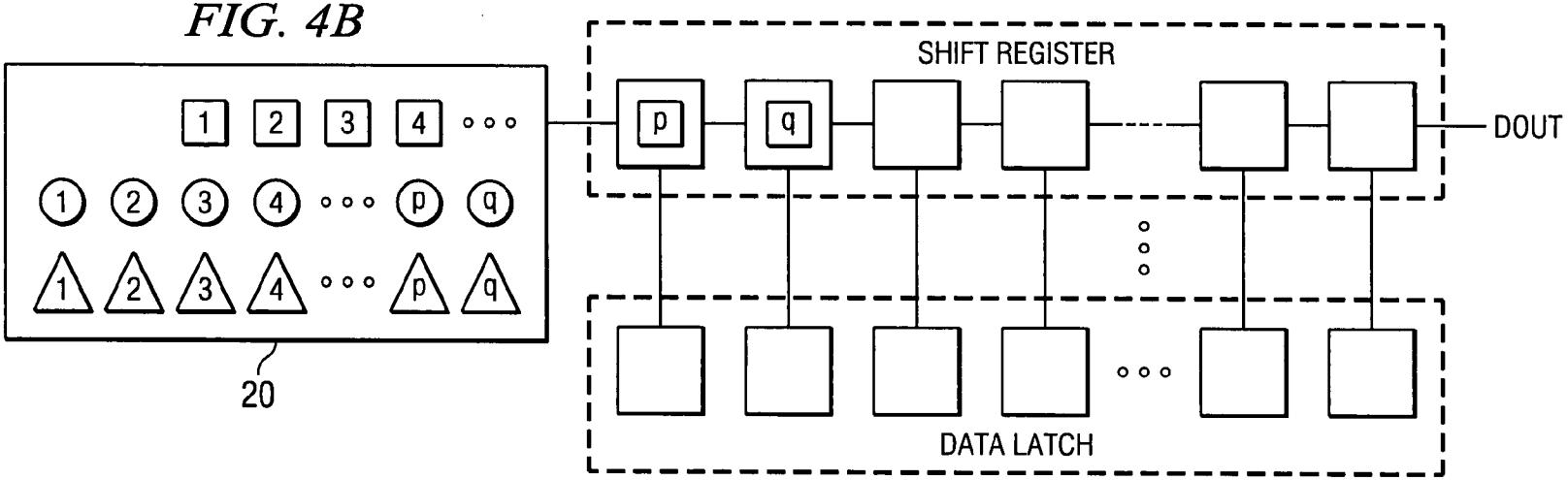
Figure 5A:
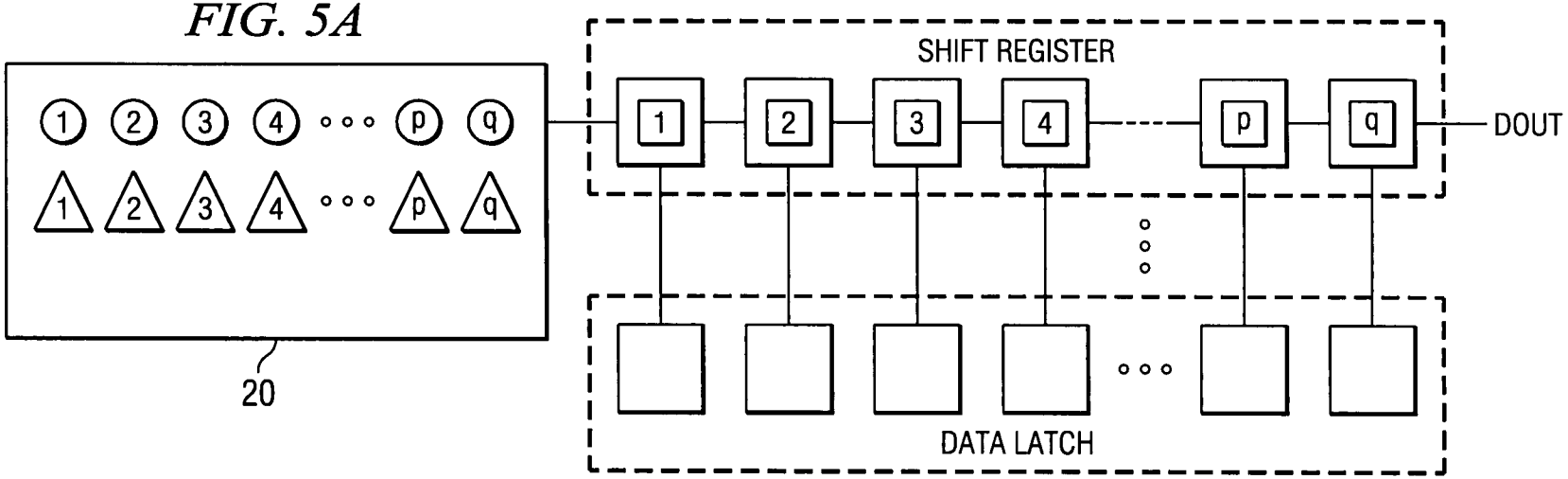
FIG. 5 is a second diagram illustrating the operation of the LED display system.

FIGS. 4-6 are diagrams illustrating the operation of the aforementioned LED display system.

In the example shown in FIGS. 4-6, the flip-flops FF1-1-FF1-16 of each LED driver are represented by one shift register, and flip-flops FF2-1-FF2-16 of each LED driver are represented as a data latch that holds the data of the shift register.

Also, in the example shown in FIGS. 4-6, the data series '1', '2', . . . , 'p' represented by square, circular, and triangular symbols represent the control data for one line.

Figure 5B:
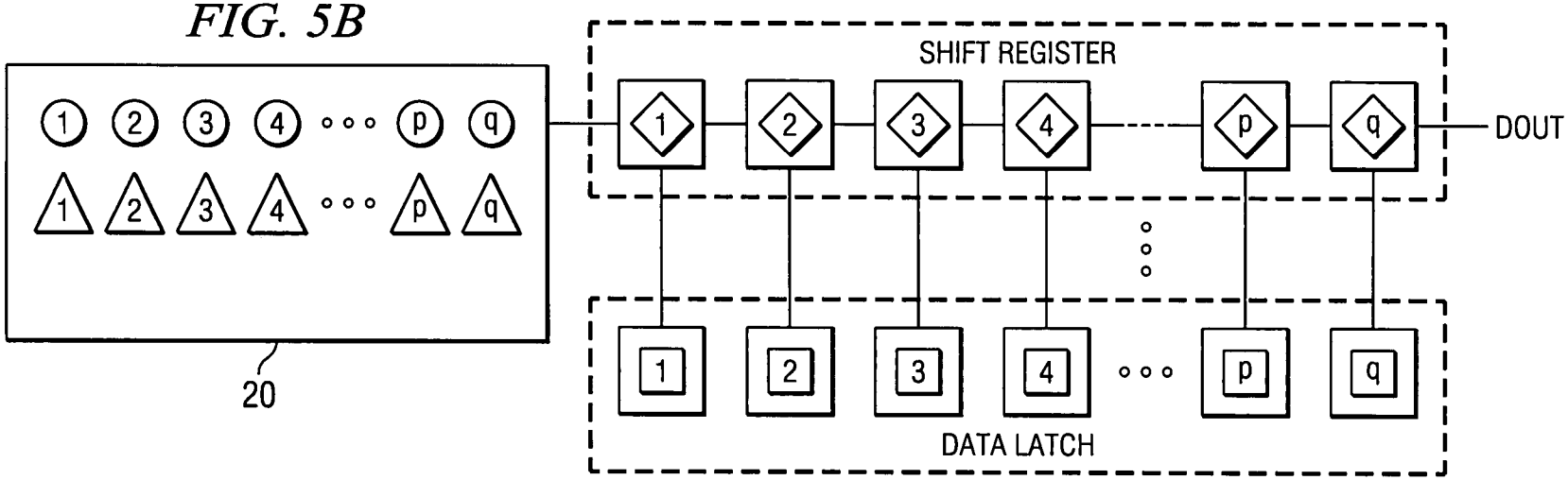

FIG. 4(A) shows the situation when the first control data 'q' in the data series represented by the square symbol is input from control device 20 into the shift register. FIG. 5(B) shows the situation when the second data 'p' is input into the shift register.

The data series represented by the square symbol are input sequentially to the shift register. FIG. 5(A) shows the state when all of the data are held in the shift register. At that time, when a high-level pulse is output as latch signal XLAT from control device 20, as shown in FIG. 5(B), the data series represented by the square symbol and held in the shift register is held in the data latch. At that time, new data in the rhombus indicating an abnormality of each output channel are held in the shift register.

Figure 5C:
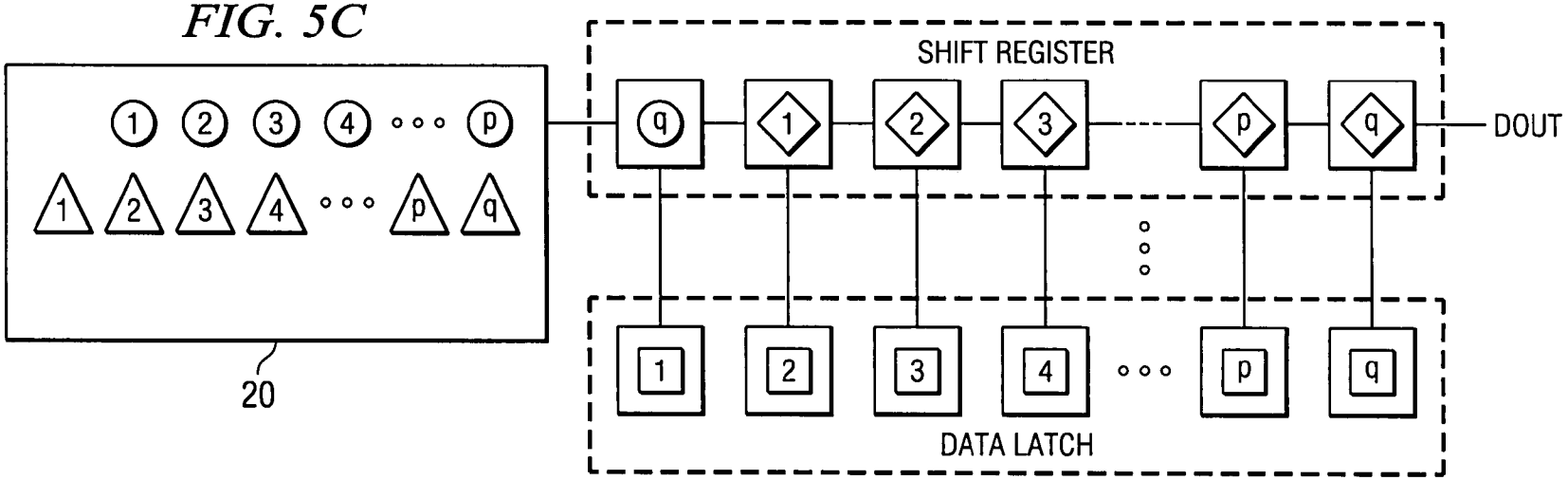
Figure 5D:
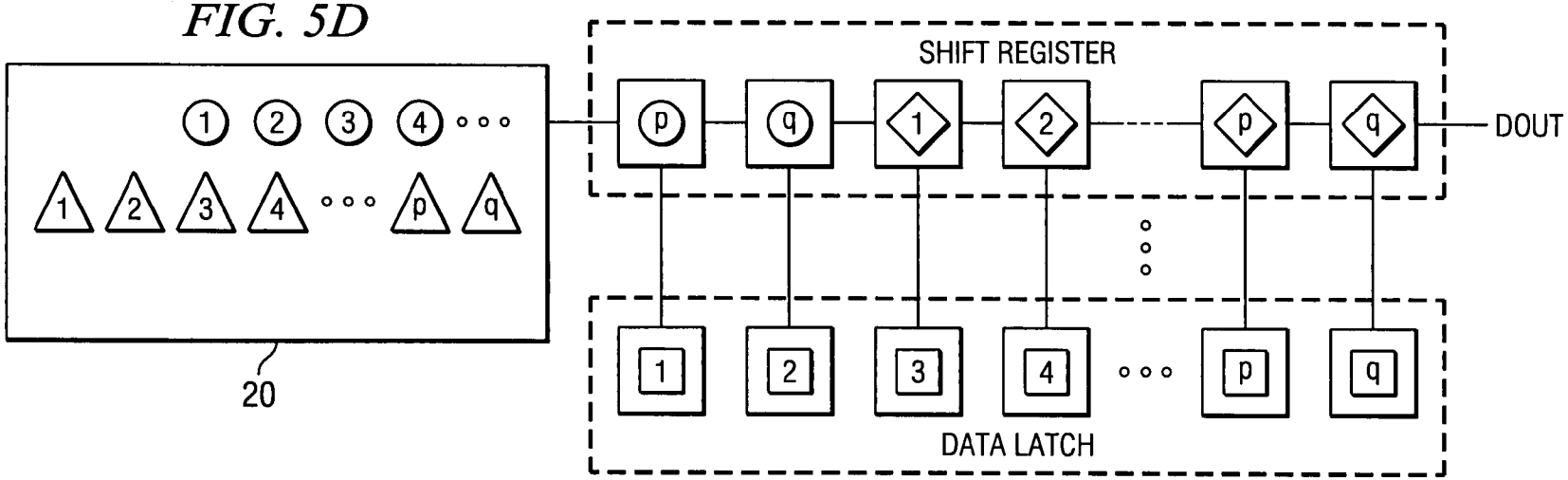

After the data (in the rhombus) used for indicating an abnormality are held in the shift register, data series 'q', 'p', . . . represented by the circular symbol is input continuously into the shift register from control device 20 (FIG. 5(C), FIG. 5(D)).

Figure 6A:
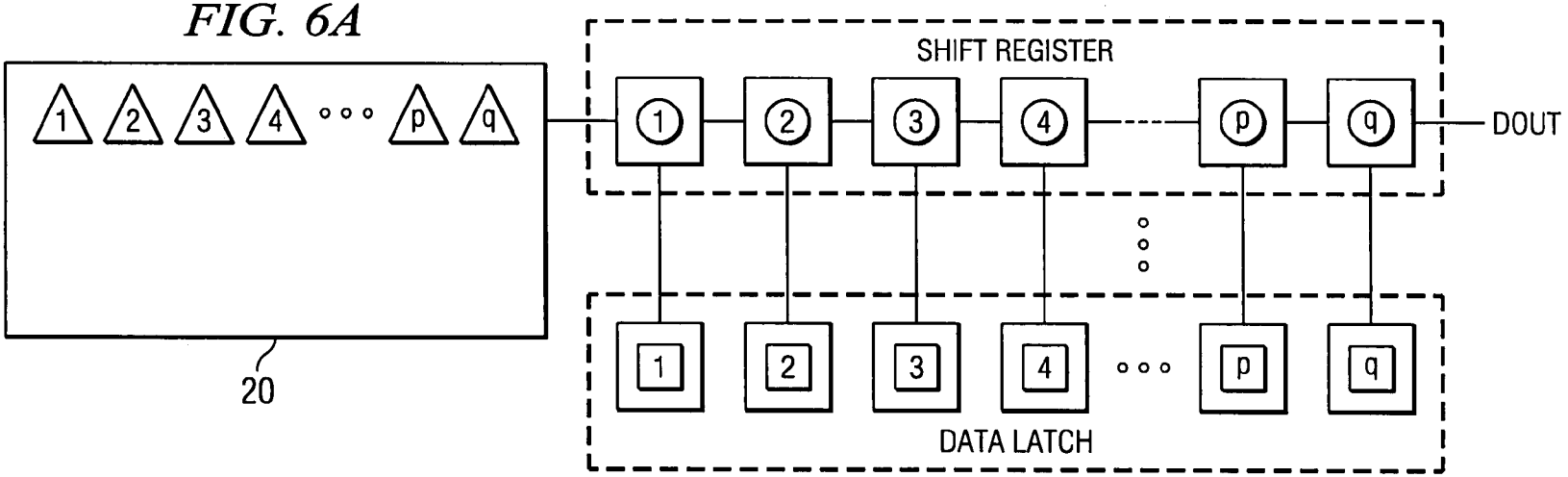
FIG. 6 is a third diagram illustrating the operation of the LED display system.
Figure 6B:
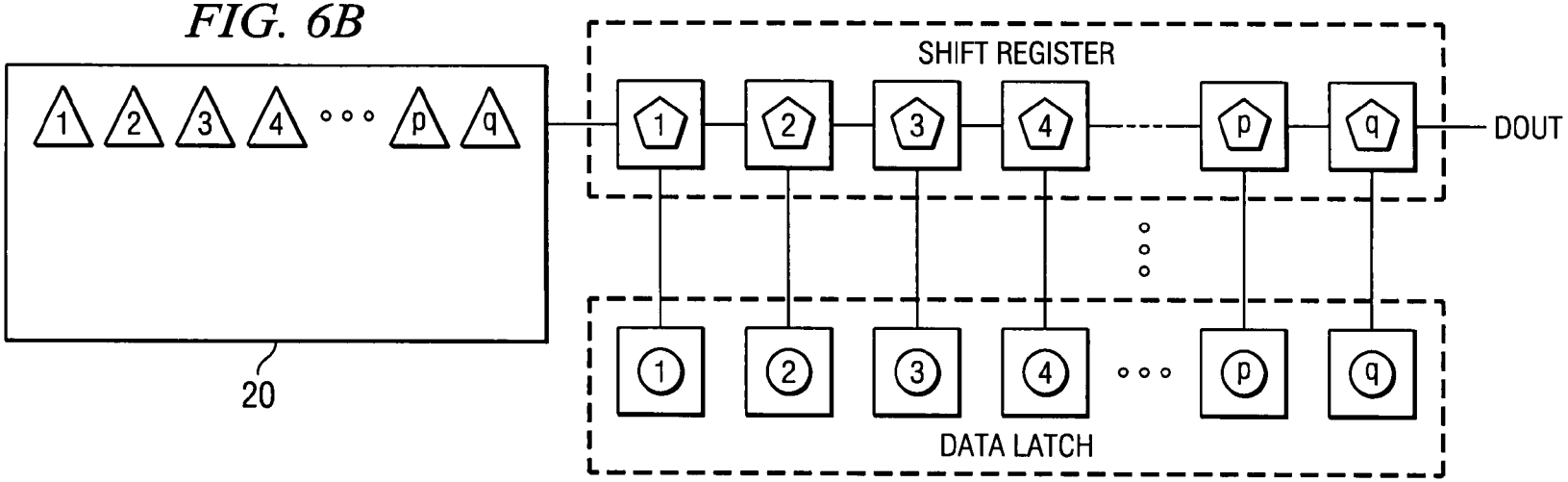

When all of the data represented by the circular symbol are held in the shift register (FIG. 6(A)), a high-level pulse is output as latch signal XLAT from control device 20 in the same way as for the case shown in FIG. 5(B). As a result, the data series represented by the circular symbol is held in the data latch, and the new data (in the pentagon) used for reporting an abnormality are held in the shift register (FIG. 6(B)).

Figure 6C:
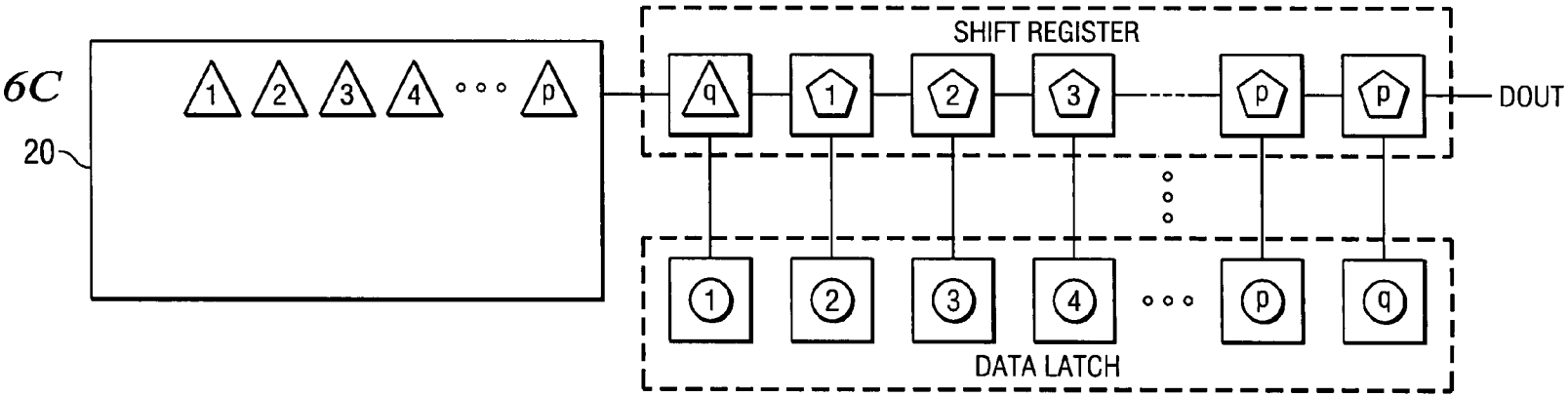

Data series 'q', 'p', . . . represented by the triangular symbol is then input continuously from control device 20 into the shift register (FIG. 6(C)), and the process is repeated in the same way as described above.

As explained above, by using the LED display system shown in FIG. 1, when latch signal XLAT changes from the low to the high level and the control data held in flip-flop FF1-i is first held in flip-flop FF2-i, the control data in flip-flop FF1-i is updated with the data reporting the abnormality of the drive signal at terminal Toi. Then, like the control data input from control data generating unit 21, the updated data held in flip-flop FF2-i are shifted in LED drivers 10-1-10-K connected in cascade, output sequentially from LED driver 10-K in the final section, and obtained by the data acquisition unit 22 of control unit 20.

In this way, the information reporting the presence/absence of an abnormality in the drive signal at each output channel of LED drivers 10-1-10-16 can be transferred to control device 20 by using only the line connecting the terminal T4 of LED driver 10-K in the final section to data acquisition unit 22. In other words, the number of lines used for transferring the information output from each LED driver can be significantly reduced.

Also, the data for reporting an abnormality held in flip-flop FF1-i can be output to data acquisition unit 22 at the same time that the control data is transferred to each flip-flop FF1-i of LED drivers 10-1-10-K. Consequently, there is no need to assign a special processing period for transferring the data for reporting an abnormality to the control device. In this way, the output data from the LED drivers can be transferred efficiently to the control device without reducing the processing speed of the system. In addition, since no processing is added by this data transfer operation, the power loss is not increased.

Figure 10:
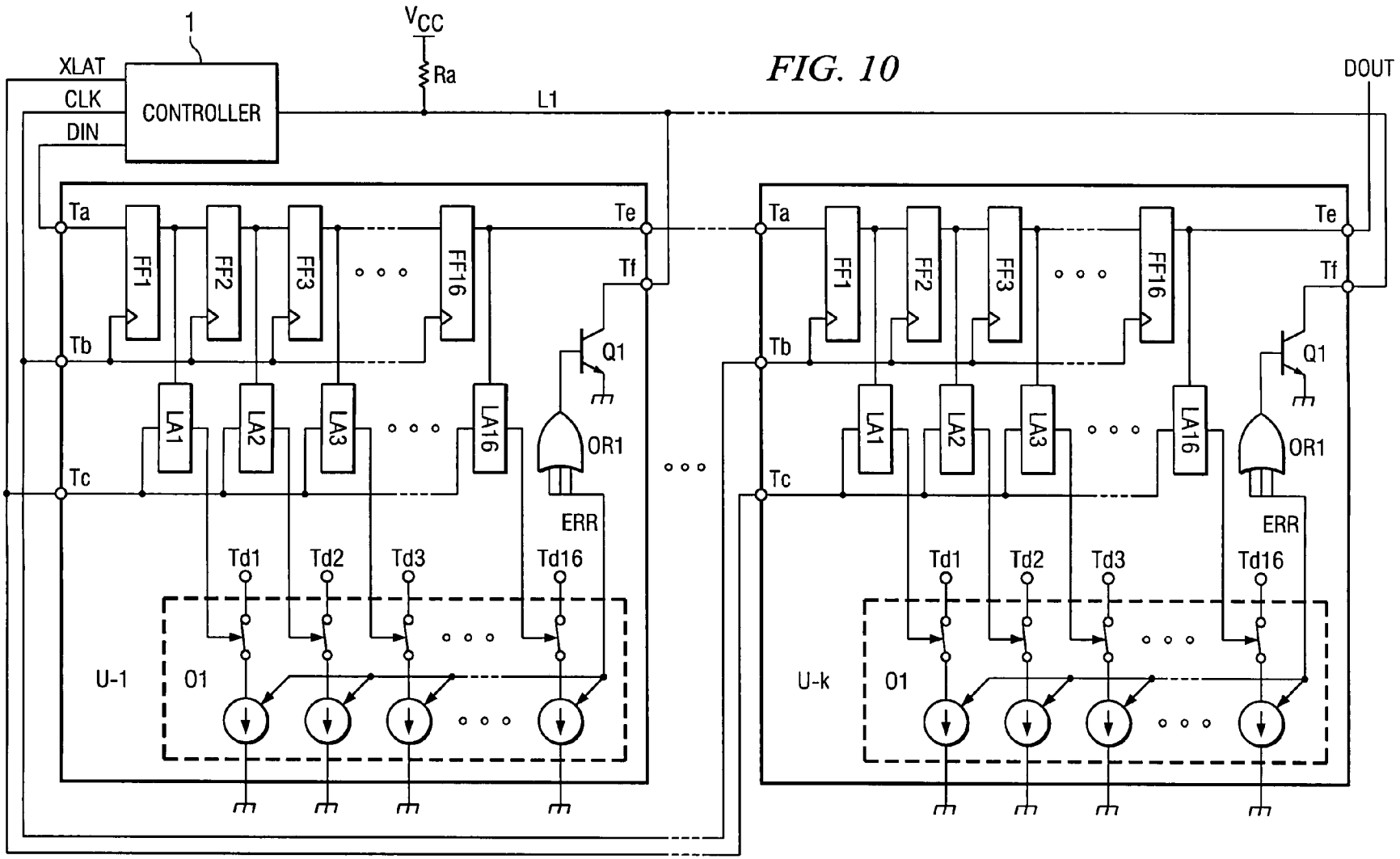
FIG. 10 is a block diagram illustrating an example of the configuration of a conventional LED display system.

The number of the terminals of LED drivers 10-1-10-K is one less than that of LED drivers U-1-UK shown in FIG. 10. This is because LED drivers 10-1-10-K do not have the terminal corresponding to terminal Tf of LED drivers U-1-UK. The terminal used for outputting the internal information of an LED driver in the conventional technology can be omitted by combining it with the output terminal for the control data. Consequently, when the LED drivers are realized using semiconductor integrated circuit, the number of pins can be reduced.

Second Embodiment

Figure 7:
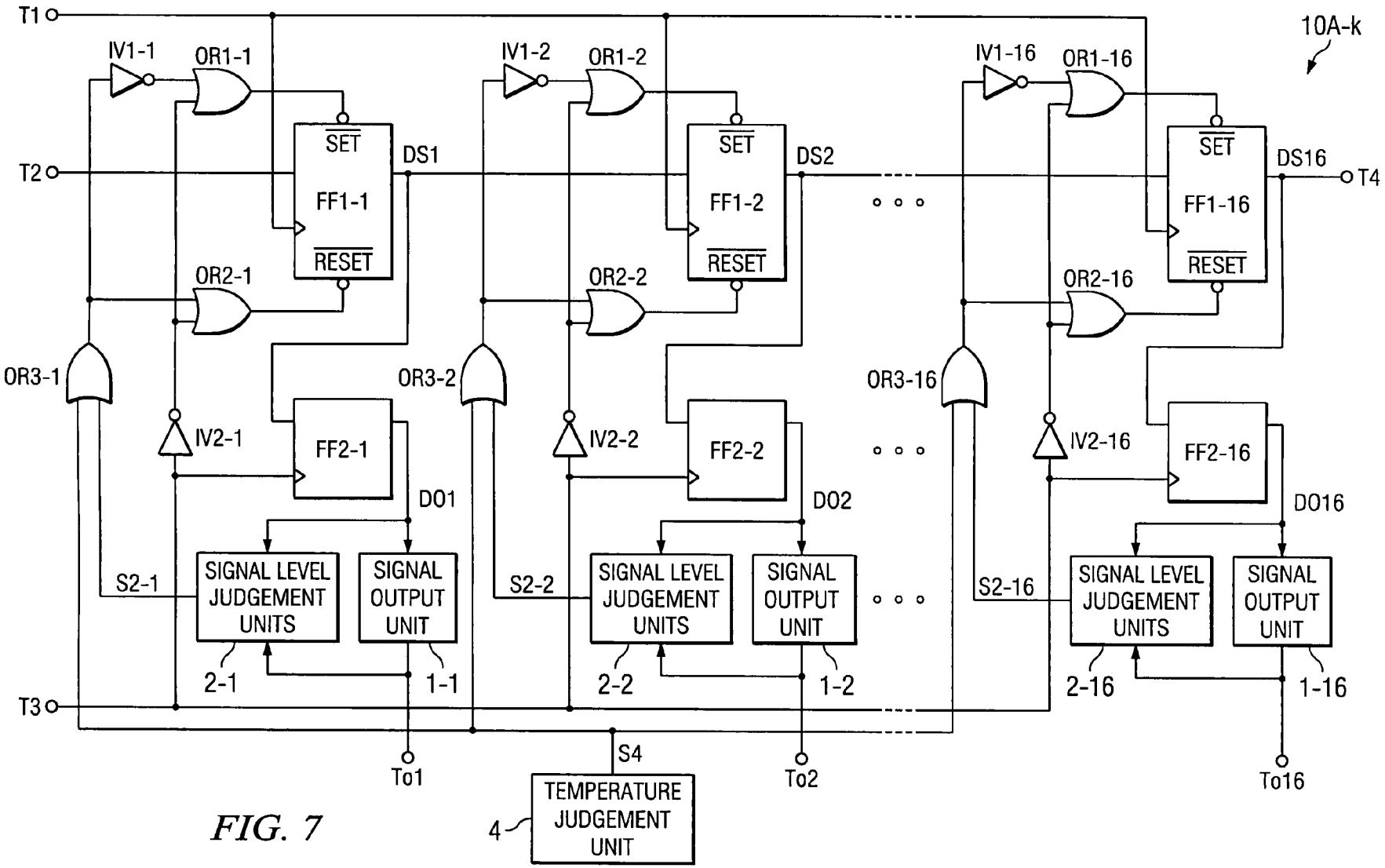
FIG. 7 is a block diagram illustrating an example of the configuration of the LED driver disclosed in the second embodiment of the present invention.

FIG. 7 is a block diagram illustrating an example of the configuration of the LED driver disclosed in a second embodiment of the present invention. The same symbols in FIGS. 2 and 7 represent the same respective constituent elements.

LED driver 10A-k shown in FIG. 7 has the same configuration as LED driver 10-k shown in FIG. 2. In addition, it has OR-gates OR3-1, . . . , OR3-16 and temperature judgment unit 4.

Temperature judgment unit 4 is one embodiment of the second judgment unit used in the present invention.

The output signal S2-i of signal level judgment unit 2-i and the output signal S4 of temperature judgment unit 4 are input to two-input OR-gate OR3-i. Their logical sum is input to inverter IV1-i and OR-gate OR2-i.

Temperature judgment unit 4 determines whether the temperature of LED driver 10-k has reached a prescribed temperature and outputs the judgment result as signal S4. For example, if the temperature of LED driver 10-k exceeds the threshold value, signal S4 with a logical value of '1' is output. If the temperature is below the threshold value, signal S4 with a logical value of '0' is output.

By using LED driver 10A-k with the aforementioned configuration, when a high-level pulse is input as latch signal XLAT, if the temperature of LED driver 10-k exceeds the threshold value, a signal of '1' is input to inverter IV1-i and OR-gate OR2-i. As a result, the signal held in flip-flop FF1-i becomes '1.'

In the LED display system shown in FIG. 1, when said LED drivers 10A-1-10A-K are used instead of LED drivers 10-1-10-K, if there is an LED driver whose temperature exceeds the threshold value, all 16 bits of the data for reporting the abnormality of that LED driver obtained in data acquisition unit 22 becomes '1.'

As explained above, by using the LED display system having LED driver 10A-k shown in FIG. 7, the same effects as those of the LED display system shown in FIG. 1 can be realized, and the LED driver with an abnormal temperature can be specified on the basis of the data obtained by data acquisition unit 22. Consequently, it is possible to ascertain the state of the system more correctly.

Third Embodiment

Figure 8:
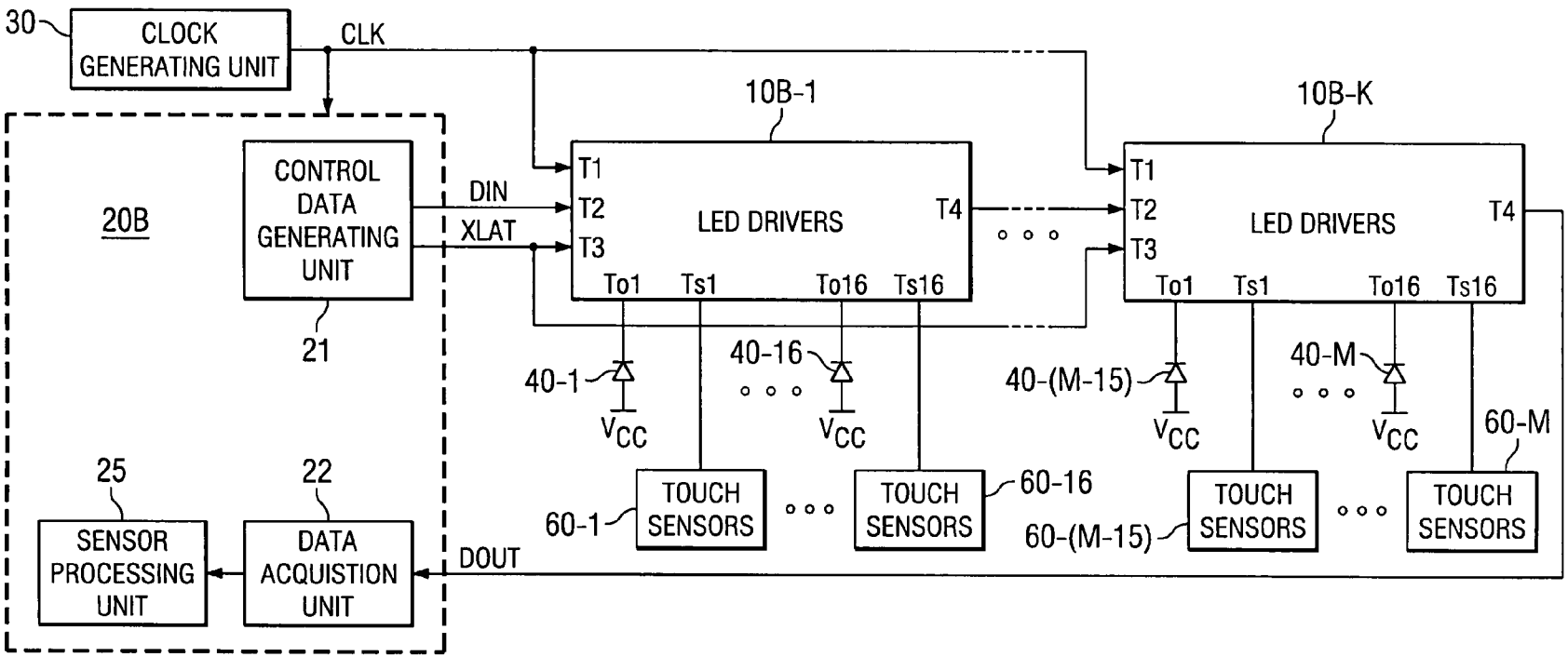
FIG. 8 is a block diagram illustrating an example of the configuration of the LED display system disclosed in the third embodiment of the present invention.

FIG. 8 is a block diagram illustrating an example of the configuration of the LED display system disclosed in a third embodiment of the present invention. The same symbols in FIGS. 1 and 8 represent the same respective constituent elements.

The LED display systems shown in FIGS. 1 and 8 are different in the following three ways.

Figure 9:
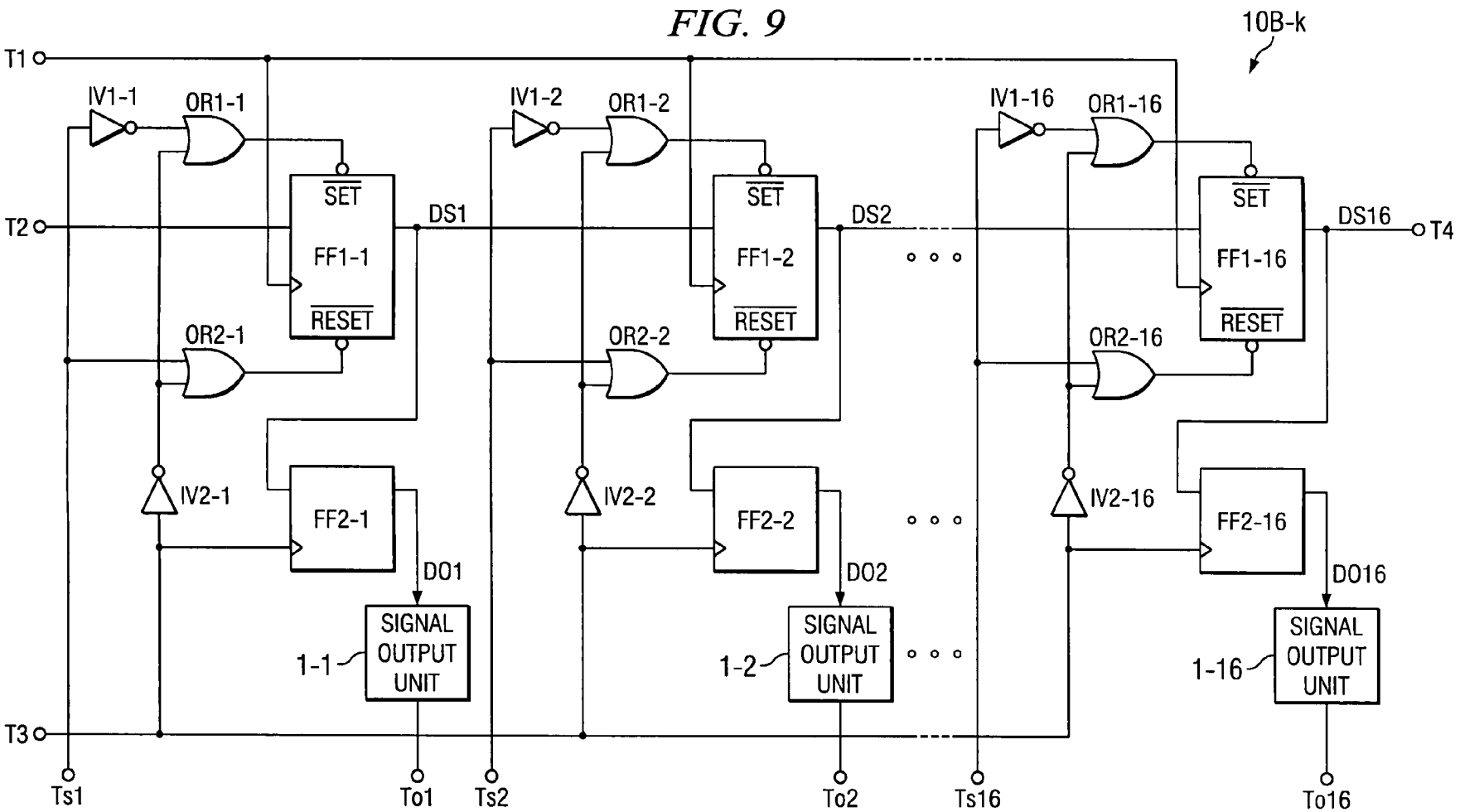
FIG. 9 is a block diagram illustrating an example of the configuration of the LED driver disclosed in the third embodiment of the present invention.

In the LED display system shown in FIG. 8, LED drivers 10-1-10-K shown in FIG. 1 are replaced with LED drivers 10B-1-10B-K shown in FIG. 9.

Also, the control device 20 shown in FIG. 1 is replaced with control device (20B) having control data generating unit 21, data acquisition unit 22, and sensor processing unit 25.

The LED display system shown in FIG. 8 has touch sensors 60-1-60-M as one embodiment of the sensor element used in the present invention.

The rest of the configuration is the same for the LED display systems shown in FIGS. 1 and 8.

These differences will be explained below.

LED Drivers 10B-1-10B-K

For LED driver 10B-k, as shown in FIG. 9, in LED driver 10-k shown in FIG. 2, signal level judgment units 2-1-2-16 are eliminated. Instead, an equivalent configuration using terminals Ts1-Ts16 is adopted.

Terminal Tsi is connected to the input terminal of inverter IV1-i and to one of the input terminals of two-input OR-gate OR2-i. Consequently, when latch signal XLAT is at the high level, the value set in flip-flop FF1-i is determined by the value of the signal input from terminal Tsi.

Touch Sensors 60-1-60-M

Touch sensors 60-1-60-M are used to detect contact by an object. The detection result is output as digital signal '1' or '0.' The output signals of the detection results are input to said terminals Ts1-Ts16 of LED drivers 10B-1-10B-K, respectively.

Touch sensor 60-1-60-M are arranged on a screen constituted with LED driver 40-1-40-M. For example, as shown in FIG. 8, these touch sensors are paired with each LED.

Sensor Processing Unit 25

Sensor processing unit 25 conducts a prescribed processing, such as specifying the contact position of an object, based on the detection results of touch sensors 60-1-60-M obtained in data acquisition unit 22.

In the LED display system shown in FIG. 8 with the aforementioned configuration, the operation of transferring the control data generated by control data generating unit 21 to LED drivers 10B-1-10B-K and controlling the on/off of LED 40-1-40-M corresponding to the control data as well as the operation of updating the data in flip-flops FF1-1-FF1-16 corresponding to the high-level pulse used as latch signal XLAT and obtaining the updated data in data acquisition unit 22 are identical to those of LED drivers 10-1-10-K described above.

In the LED display system disclosed in this embodiment, the data obtained by data acquisition unit 22 are the detection results of touch sensors 60-1-60-M, and sensor processing unit 25 conducts a process corresponding to the detection results of the sensors. This is different from the LED display system shown in FIG. 1.

Consequently, by using the LED display system shown in FIG. 8, the detection results of touch sensors 60-1-60-M arranged on the screen can be transferred to control device 20B efficiency using a very small number of lines.

Also, the detection results of touch sensors 60-1-60-M can be output to data acquisition unit 22 at the same time when the control data are transferred to LED drivers 10B-1-10B-K. Therefore, the detection results of the touch sensors can be transferred efficiently to control device 10B without reducing the processing speed of the system. In addition, since no processing is added by this data transfer operation, the power loss will not be increased.

Since the LED and touch sensors arranged adjacent to each other on the screen are connected to the common LED drivers, the wiring length can be reduced effectively compared with the case in which the lines connected to different devices. In addition, crossing of lines can be reduced. Consequently, the noise component superimposed on the detection results of the sensors can be reduced.

The present invention is not limited to the embodiments described above. Various types of modifications can be made without departing from the spirit and scope of the invention as defined by the appended claims.

In the embodiments described above, the data used to report an abnormal drive signal or abnormal temperature or the sensor data are used as the data to update the control data held in flip-flop FF1-i. However, the present invention is not limited in this way. For example, information indicating the voltage or current value of an LED driver or the temperature information can be converted into digital data by an analog/digital converter, and the digital data can also be sent to the control device. It is also possible to transfer the manufacturer's number that is preset for each LED driver or other data to the control device.

In the embodiment described above, touch sensors are used. However, it is possible to use other types of sensors. For example, light-receiving elements that can measure the brightness of light emitted by each LED can be arranged on the screen, and a data correction means can be used to correct the control data generated in the control data generating unit corresponding to the detection results of the light-receiving elements. In this way, since the difference in brightness caused by the variation in the characteristics of the LED can be corrected, deterioration of the picture quality can be prevented.

Also, the number of output channels of each LED driver, the bit width of the control data, and the circuit configuration described in the aforementioned embodiments are only examples used for the sake of explanation. The present invention is not limited to these examples. In the embodiments described above, the LED driver sinks current from the LED. However, it is also possible to use a configuration in which the LED driver sources current to the LED.

Also, in the aforementioned embodiments, an LED driver and LED display system are used as an example. The present invention is not limited to this example. The present invention can be applied to drive circuits used to drive liquid-crystal elements, organic EL elements, and other various types of display elements and to their corresponding display systems.

By using the drive circuit of the present invention, the increase in the number of lines can be prevented, and the prescribed information indicating an abnormal drive signal, etc. can be transferred efficiently to an external device.

Also, by using the display system of the present invention, the prescribed information indicating an abnormal drive signal, etc. can be obtained efficiently from the drive circuits of the display elements using a simple configuration without increasing the number of lines.

The invention claimed is:

1. A display system comprising:

multiple display elements, multiple drive circuits that generate drive signals corresponding to the input control data and supply the drive signals to the display elements and being connected in cascade whereby control data input to a first section can be shifted sequentially to sections that follow the first section, a control data generating means that generates the control data corresponding to the image to be displayed, synchronizes the generated control data with a supplied clock signal, and inputs the control data sequentially to the drive circuit in the first section of the cascade connection, a data acquiring means for obtaining data output sequentially from the drive circuit in the last section of the cascade connection;

wherein the drive circuit of the first section comprises a first data holding means that holds the input control data synchronously with a supplied clock signal, a second data holding means that holds the control data held in the first data holding means synchronously with a supplied latch signal, a signal output means that generates a drive signal corresponding to the control data held in the second data holding means and outputs the drive signal to a drive object, and a data updating means that updates the control data held in the first data holding means with data indicating prescribed information when new control data are held in the second data holding means wherein the drive circuit of the first section has a first judgment means that determines whether the level of the drive signal to be output in the signal output means reaches a prescribed level;

wherein the data updating means updates the control data held in the first data holding means each time control data in the second data holding means is updated to data corresponding to the judgment result of the first judgment means; and further comprising an abnormality detection means that detects an abnormality of the drive circuit on the basis of data obtained by the data acquiring means corresponding to the result of the first judgment means the abnormality detection means of each drive circuit being separately connected in cascade whereby the results of the first judgment means can be shifted sequentially when the control data is shifted sequentially.

2. The display system described in claim 1 wherein the drive circuit of the first section has a second judgment means that determines whether the temperature of the drive circuit reaches a prescribed temperature; and wherein the data updating means updates the control data held in the first data holding means with data corresponding to the result of the second judgment means;

and further comprising an abnormality detection means that can detect an abnormality of the drive circuit on the basis of data obtained by the data acquiring means corresponding to the result of the second judgment means.

3. The display system described in claim 2 wherein drive circuit is used to drive multiple LEDs of an LED display.

4. The display system described in claim 1 further comprising multiple sensor elements arranged on a screen constituted with the display elements, and wherein the data updating means updates the control data held in the first data holding means to the data corresponding to the detection results of the sensor elements.

5. The display system described in claim 4 wherein drive circuit is used to drive multiple LEDs of an LED display.

6. The display system described in claim 1 wherein drive circuit is used to drive multiple LEDs of an LED display.

7. The display system described in claim 1 wherein drive circuit is used to drive multiple LEDs of an LED display.

8. A drive circuit comprising:

multiple first holding circuits that are connected in cascade between the data input terminal and the data output terminal and sequentially shift the data input from the data input terminal in response to a supplied clock signal, multiple second holding circuits that correspond to the multiple first holding circuits, respectively, and hold the data held in the multiple first holding circuits in response to a supplied latch signal, multiple output circuits that correspond to the multiple second holding circuits, respectively, and supply drive signals corresponding to the data held in the multiple second holding circuits to multiple output terminals, multiple first monitoring circuits that correspond to the multiple output terminals, respectively, and supply the signals corresponding to the states of the output terminals to the multiple first holding circuits in response to the latch signal for storing data corresponding to the states of output terminals in the multiple first monitoring circuits each time data in the second data holding means is updated where the states of the monitoring circuits are sequentially shifted by the supplied clock signal.

9. The drive circuit described in claim 8 further comprising a second monitoring circuit that supplies a temperature signal to the multiple first holding circuits in response to the latch signal.

10. The drive circuit described in claim 9 wherein the drive circuit is used to drive multiple LEDs of an LED display.

11. The drive circuit described in claim 8 wherein the drive circuit is used to drive multiple LEDs of an LED display.

12. A display system comprising:

multiple display elements, multiple drive circuits that generate drive signals corresponding to the input control data and supply the drive signals to the display elements and being connected in cascade whereby control data input to a first section can be shifted sequentially to sections that follow the first section, a control data generating circuit that generates the control data corresponding to the image to be displayed, synchronizes the generated control data with a supplied clock signal, and inputs the control data sequentially to the drive circuit in the first section of the cascade connection, a data acquiring circuit that obtains data output sequentially from the drive circuit in the last section of the cascade connection;

a first data holding circuit that holds the input control data synchronously with a supplied clock signal, a second data holding circuit that holds the control data held in the first data holding circuit synchronously with a supplied latch signal, a signal output circuit that generates a drive signal corresponding to the control data held in the second data holding circuit and outputs the drive signal to a drive object, and a data updating circuit that updates the control data held in the first data holding circuit with data indicating prescribed information when new control data are held in the second data holding circuit wherein the drive circuit of the first section has a first judgment circuit that determines whether the level of the drive signal to be output in the signal output circuit reaches a prescribed level;

the data updating circuit updates the control data held in the first data holding circuit each time control data in the second data holding circuit is updated to data corresponding to the judgment result of the first judgment circuit; and wherein the display system has an abnormality detection circuit that detects an abnormality of the drive circuit on the basis of data obtained by the data acquiring circuit corresponding to the result of the first judgment circuit the abnormality detection circuit for each drive circuit being separately connected in cascade whereby the results of the first judgment circuit can be shifted sequentially when the control data is shifted sequentially.

* * * * *